US009816284B2

(12) United States Patent
Konishi

(10) Patent No.: US 9,816,284 B2
(45) Date of Patent: Nov. 14, 2017

(54) RETROFITTING STRUCTURE FOR EXISTING BUILDING

(71) Applicant: Nippon Steel & Sumikin Engineering Co., Ltd., Shinagawa-ku, Tokyo (JP)

(72) Inventor: Yoshinao Konishi, Tokyo (JP)

(73) Assignee: Nippon Steel & Sumikin Engineering Co., Ltd., Tokyo (JP)

( * ) Notice: Subject to any disclaimer, the term of this patent is extended or adjusted under 35 U.S.C. 154(b) by 0 days.

(21) Appl. No.: 15/115,801

(22) PCT Filed: Dec. 8, 2015

(86) PCT No.: PCT/JP2015/084347

§ 371 (c)(1),
(2) Date: Aug. 1, 2016

(87) PCT Pub. No.: WO2016/093207

PCT Pub. Date: Jun. 16, 2016

(65) Prior Publication Data

US 2017/0009477 A1 Jan. 12, 2017

(30) Foreign Application Priority Data

Dec. 8, 2014 (JP) ..... 2014-247977

(51) Int. Cl.
*E04H 9/02* (2006.01)
*E04G 23/02* (2006.01)
(Continued)

(52) U.S. Cl.
CPC ..... *E04H 9/027* (2013.01); *E04B 1/24* (2013.01); *E04B 1/98* (2013.01); *E04G 23/02* (2013.01);
(Continued)

(58) Field of Classification Search
CPC E04H 9/027; E04H 9/024; E04H 9/02; E04G 23/0218; E04G 23/02; E04B 1/98; E04B 1/24; E04B 1/18; E04B 1/36
(Continued)

(56) References Cited

U.S. PATENT DOCUMENTS 8,590,220 B2 * 11/2013 Ozaki ..... E04H 9/02 52/167.1
8,677,699 B2 * 3/2014 Tagawa ..... E04H 9/021 188/380
(Continued)

FOREIGN PATENT DOCUMENTS

JP 10-018639 1/1998
JP 10-152998 6/1998
(Continued)

OTHER PUBLICATIONS

International Search Report Report relating to International Application No. PCT/JP2015/084347, dated Feb. 23, 2016.
(Continued)

*Primary Examiner* — Brian Glessner
*Assistant Examiner* — Adam Barlow
(74) *Attorney, Agent, or Firm* — McCarter & English, LLP

(57) ABSTRACT

Provided is a retrofitting structure for existing building that does not require the addition of a foundation specific to the retrofitting structure, can implement seismic retrofitting at any floors only of the existing building, and hardly causes a large drawing force resulting from eccentric bending moment that may act on the seismic retrofitting structure. A retrofitting structure 100 for existing building includes: a reinforcing frame 10 including a frame member 11 and a vibration control member 12 interposed in the frame member, the reinforcing frame being provided on an outer wall
(Continued)

surface of an existing building B having an overhang T on the outer wall surface so as to surround the overhang T; and a vertical truss member 30 and a horizontal truss member 20 configured to couple the reinforcing frame 10 and the outer wall surface.

8 Claims, 13 Drawing Sheets

(51) Int. Cl.
*E04B 1/24* (2006.01)
*E04B 1/98* (2006.01)
*E04H 15/62* (2006.01)

(52) U.S. Cl.
CPC ..... *E04G 23/0218* (2013.01); *E04H 9/02* (2013.01); *E04H 9/024* (2013.01); *E04H 15/62* (2013.01); *E04B 2103/06* (2013.01)

(58) Field of Classification Search
USPC ..... 52/167.3, 167.1
See application file for complete search history.

(56) References Cited

U.S. PATENT DOCUMENTS

| | | | | |
|---|---|---|---|---|
| 2001/0045069 | A1* | 11/2001 | Constantinou | E04H 9/02 52/167.3 |
| 2002/0095879 | A1* | 7/2002 | Fanucci | E04H 9/02 52/167.3 |
| 2008/0289267 | A1* | 11/2008 | Sarkisian | E04H 9/02 52/167.3 |
| 2012/0167490 | A1* | 7/2012 | Balducci | E04H 9/021 52/167.3 |

FOREIGN PATENT DOCUMENTS

| | | |
|---|---|---|
| JP | 12004-176460 | 6/2004 |
| JP | 2005-155049 | 6/2005 |
| JP | 2006-274613 | 10/2006 |
| JP | 2009-097165 | 5/2009 |
| JP | 2009-249851 | 10/2009 |
| JP | 2011-102498 | 5/2011 |
| JP | 2012-031581 | 2/2012 |
| JP | 2012-233374 | 11/2012 |
| JP | 2013-049954 | 3/2013 |
| JP | 2013-087540 | 5/2013 |

OTHER PUBLICATIONS

European Search Report based on co-pending European Application No. 15866532, dated Nov. 22, 2016 3 Pages.

* cited by examiner

RETROFITTING STRUCTURE FOR EXISTING BUILDING

RELATED APPLICATIONS

This application is a national stage application filed under 35 USC 371 of PCT/JP2015/084347, filed Dec. 8, 2015, which claims the benefit of Japanese Patent Application No. 2014-247977, filed Dec. 8, 2014, all of which are incorporated herein, in entirety, by reference.

TECHNICAL FIELD

The present invention relates to a retrofitting structure for existing buildings.

BACKGROUND ART

For a method of seismic retrofitting for existing architectural structures, such as a building or a condominium, a method of reinforcing columns and beams inside of a building or of adding an anti-seismic wall is available. Such a retrofitting method, however, is not favorable enough because it requires the work inside of the building, meaning that the building cannot be used during the work.

Then another method of providing the outer wall surfaces of an existing building with seismic retrofitting has been mainstream so as to enable the seismic retrofitting while allowing the use of the existing building, and typical examples thereof include a method of direct-attaching a framed steel brace and a method of adding a framed steel brace structure.

The method of direct-attaching a framed steel brace is to directly attach a framed steel brace internally including a steel brace to the outer wall surfaces of an existing building. This method is not suitable for an outer wall surface provided with an overhang such as a balcony, eaves or a louver, because the steel brace and the overhang interfere with each other.

The method of adding a framed steel brace structure is to construct the foundation specific to a steel brace structure beside the outer wall surface to be reinforced, and a steel brace structure is added one by one on this foundation. Referring now to FIG. 11, this method of adding a framed steel brace structure is described in details.

As shown in FIG. 11, a foundation K including an underground beam not illustrated is firstly added to the left and right outer wall surfaces along the longitudinal direction of an existing building B, such as a condominium, and this underground beam is connected to the underground foundation of the existing building B for integration. Thereafter, a steel brace structure H is constructed on the foundation K to the top story while joining outer columns of the existing building B and outer beams on each floor with the steel brace structure H for seismic retrofitting.

FIG. 12 shows various types of cross-sectional forces generated at the joints of the steel brace structure H and the existing building B.

In FIG. 12, $M_{eh}$ denotes bending moment at the joint, $Q_{uh}$ denotes a shear force at the joint, and $N_e$ denotes a tensile force at the joint, and the relationships of $M_{eh}=Q_{uh}\times e_h$ and $N_e=M_{eh}/L$ hold, where $Q_P$ denotes a shear force at the added structure that is $Q_{uh}$, $e_h$ denotes a distance between the steel brace core and the beam end, and L denotes a width of the steel brace structure H viewed from the front.

As shown in the drawing, a horizontal shear force only is transmitted between the added steel brace structure H and the existing building B, while a vertical shear force is transmitted to the added foundation K via the vertical members of the retrofitted steel brace structure H, and therefore the foundation K has to be added. Further, a tensile force $N_e$ is generated at the joint between the steel brace structure H and the existing building B, which results from eccentric bending moment.

In this way the foundation K has to be added, and therefore also when seismic retrofitting just for the middle-level floors or the top-level floors is to be performed, the foundation K has to be added, and a steel brace structure H standing from the foundation K, i.e., the steel brace structure H including practically unnecessary steel braces for lower-level floors, has to be constructed. This necessitates such an uneconomical retrofitting structure, and since the foundation K to be added has to be within the clearance limit, if it is difficult to construct the foundation, such retrofitting strategy cannot be performed.

Instead of the steel brace structure H, another seismic retrofitting structure is available as shown in FIG. 13, which provides a stud-type dumper D between the outer beams OB on any upper-level and lower-level floors of an existing building. Such a stud-type dumper D is fixed to the outer beams OB using anchor bolts A via base plates P, and a large drawing force X will act on the anchor bolts A, which results from bending moment generated similarly to FIGS. 11 and 12 (a pressing force X will act on the anchor bolts on the other side). In order to act against this drawing force X, through holes have to be bored in the outer beams OB, and tendons TB, such as PC steel rods, have to be disposed therein and be tightened for joining. If the building does not have such outer beams OB, outer beams OB have to be added so as to act against the drawing force X at the tendons TB.

For the conventionally known techniques, Patent Documents 1 and 2 are available. Patent Document 1 describes the technique of providing an existing building with a seismic retrofitting frame having a retrofitting post and a retrofitting steel beam externally, in which the retrofitting steel beam is joined to an existing outer beam without joining the retrofitting post and an existing outer post. This structure makes a horizontal force generated during earthquakes act on the seismic retrofitting frame, and therefore the existing building can have a seismic retrofitted structure. Such a structure, however, still has the problem as stated above because the retrofitting post has to be constructed from the foundation, meaning that the foundation specific to the seismic retrofitting frame is required.

Patent Document 2 describes the technique of forming a pin supporting portion at a post-beam joint on the outer surface of an existing building, supporting an outer shell reinforcing frame including an outer shell post frame that is elongated upward and downward from each layer so that the outer shell post frame, an outer shell beam frame that is elongated continuously along the beams, and the pin supporting portion make up the post-beam joint, and making a connection at the gap between the outer shell post frames elongated upward or downward, thus constructing a lattice outer shell reinforcing frame on the outer surface of the existing building.

Such an outer shell reinforcing structure does not require the addition of the foundation for the outer shell reinforcing structure, but the structure simply includes the pin supporting portions at the post-beam joints on the outer surface of the existing building, and therefore it is not certain whether, if a large drawing force acts on the pin supporting portions as stated above, the strength of these joints can resist the drawing force or not.

CITATION LIST

Patent Literature

Patent Literature 1: JP 2009-249851 A
Patent Literature 2: JP 2009-97165 A

SUMMARY OF INVENTION

Technical Problem

In view of the above-stated problems, the present invention aims to provide a retrofitting structure for an outer wall surface of an existing building including an overhang on the outer wall surface that does not require the addition of a foundation specific to the retrofitting structure, can implement seismic retrofitting at any floors only of the existing building, and hardly causes a large drawing force resulting from eccentric bending moment that may act on the seismic retrofitting structure.

Solution to Problem

To fulfill the above aim, a retrofitting structure for existing building according to the present invention includes; a reinforcing frame including a frame member and a vibration control member interposed in the frame member, the reinforcing frame being provided on an outer wall surface of an existing building having an overhang on the outer wall surface so as to surround the overhang; and a vertical truss member and a horizontal truss member configured to couple the reinforcing frame and the outer wall surface.

A retrofitting structure for existing building according to the present invention is provided so as to surround an overhang on the outer wall surface of the existing building, and the reinforcing frame including a vibration control member is coupled to the outer wall surface via a vertical truss member and a horizontal truss member. Since the reinforcing frame is installed so as to surround the overhang, the view from the windows of the existing building is not blocked. Further, the reinforcing frame and the outer wall surface are connected via the horizontal truss member and the vertical truss member, whereby a horizontal shear force acting on the reinforcing frame can be transmitted to the existing building via the horizontal truss member, and a vertical force resulting from the eccentric bending moment acting on the reinforcing frame can be transmitted to the existing building via the vertical truss member. Therefore this does not require the addition of a foundation specific to the retrofitting structure, and can implement seismic retrofitting on any floors. For instance, in an existing building with ten floors, a retrofitting structure can be installed on the outer wall surface of the all floors without providing a foundation, and additionally a retrofitting structure can be installed on the outer wall surface on the sixth floor only to be seismic retrofitted or from the sixth to the tenth floors without any retrofitting structure on the outer wall surface from the first to the fifth floors.

Herein, the "existing building" includes various architectural structures, including existing condominiums, buildings, schools, official buildings for central and local government, and public facilities such as station buildings, airports and buildings for water supply and sewerage.

The "overhang" includes a general structure that projects outwards from the outer wall surface of an existing building, such as a balcony, eaves or a louver.

The wording "being provided . . . so as to surround the overhang" refers to the installation of a reinforcing frame around an overhang as well as the installation of it at a forward position of the overhang. This includes the form where a vertical member of the reinforcing frame is present at some position along the overhang, i.e., vertical members making up the reinforcing frame are present at left and right ends of the overhang, such as a balcony, and another vertical member is present at some position along the overhang as well. In any form, the reinforcing frame is installed so that it does not block the view from windows, for example, that may be present at the back of the overhang. Therefore even in a form including a vertical member of the reinforcing frame at some position along the overhang, no window is present at the back of this vertical member, i.e., a structure such as a wall or a post of the building is present there, and therefore the vertical member does not block the view from the windows.

The reinforcing frame is made up of a plurality of steel members, for example, the steel members are assembled into a lattice shape to form the reinforcing frame, and in one form, a vibration control member is interposed at a vertical member making up this reinforcing frame.

Examples of the "vibration control member" include a stud-type vibration control damper (hysteresis type damper made of steel materials, viscoelastic damper made of high-damping rubbers, and viscosity damper made of fluid), a brace, and a brace with a damper. Especially when a stud-type vibration control damper is used, bending moment generated at the reinforcing frame is not transmitted to the connection portion with the outer wall surface of the existing building via the horizontal truss members and the vertical truss members, and therefore no local drawing force resulting from the transmission of bending moment is generated. Therefore, there is no need to install tendons (e.g., PC steel rods, PC steel stranded cables) in the existing through holes or through holes in outer beams added to act against such a drawing force.

In the retrofitting structure of the present embodiment, horizontal truss members and vertical truss members may be directly joined to the outer wall surface of an existing building via anchors (adhesion-type post-installed anchors) or the like, or a steel member for connection may be attached to the outer wall surface beforehand, and the horizontal truss members may be joined to this steel member for connection.

The horizontal truss member and the vertical truss member may be made of steel members having desired stiffness, such as a L-steel, a C-steel, a square pipe, or a H-steel.

Another embodiment for a retrofitting structure for existing building of the present invention includes: a connection frame including a frame member, the connection frame being provided on an outer wall surface of an existing building having an overhang on the outer wall surface so as to surround the overhang; a reinforcing frame to be connected to the connection frame, the reinforcing frame including a frame member and a vibration control member interposed in the frame member; and a vertical truss member and a horizontal truss member configured to couple the connection frame and the reinforcing frame.

The retrofitting structure of the present embodiment includes a connection frame interposed between the outer wall surface of the existing building and the reinforcing frame. The connection frame is fixed to the outer wall surface of the existing frame, and this connection frame and the reinforcing frame are joined via the horizontal truss member and the vertical truss member.

Advantageous Effects of Invention

As can be understood from the above descriptions, the retrofitting structure for existing building of the present invention is configured so that a reinforcing frame having a vibration control member is provided so as to surround an overhang on the outer wall surface of the existing building and is connected to the outer wall surface via a vertical truss member and a horizontal truss member, whereby the view from the windows of the existing building is not blocked, there is no need to add a foundation specific to the retrofitting structure, seismic retrofitting at any floors only of the existing building can be implemented, and a large drawing force resulting from eccentric bending moment that may act on the seismic retrofitting structure can be avoided.

DESCRIPTION OF EMBODIMENTS

The following describes embodiments of a retrofitting structure for existing buildings of the present invention, with reference to the drawings. Although the drawings illustrate a condominium as one example of the existing buildings, the existing buildings as a target include various architectural structures other than a condominium, such as a building and various buildings for public facilities (and public transportation facilities). Although the drawings show an example of providing a retrofitting structure on the outer wall surface of all dwelling units from a middle-level floor to an upper-level floor of the existing building, a retrofitting structure may be provided on the entire outer wall surface of the existing building, may be provided at any floor only, or may be provided at any dwelling unit on any floor. Even when the retrofitting structure is provided on the entire outer wall surface of the existing building, the retrofitting structure of the present invention does not require the addition of a foundation specific thereto.

(Embodiment 1 of Retrofitting Structure for Existing Building)

Figure 1:
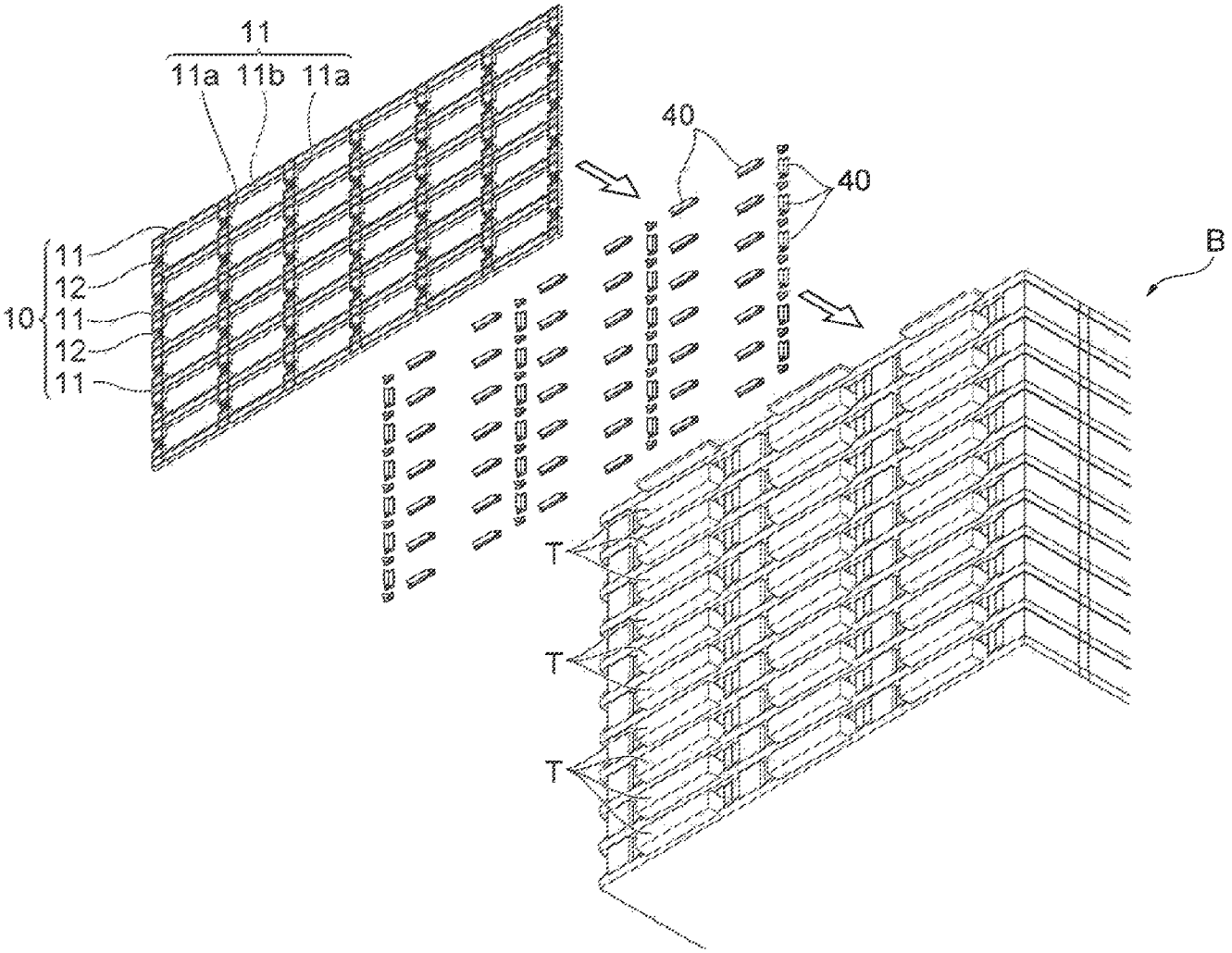
FIG. 1 schematically shows the state where a retrofitting structure of Embodiment 1 of the present invention is provided on the outer wall surface of an existing building.
Figure 2:
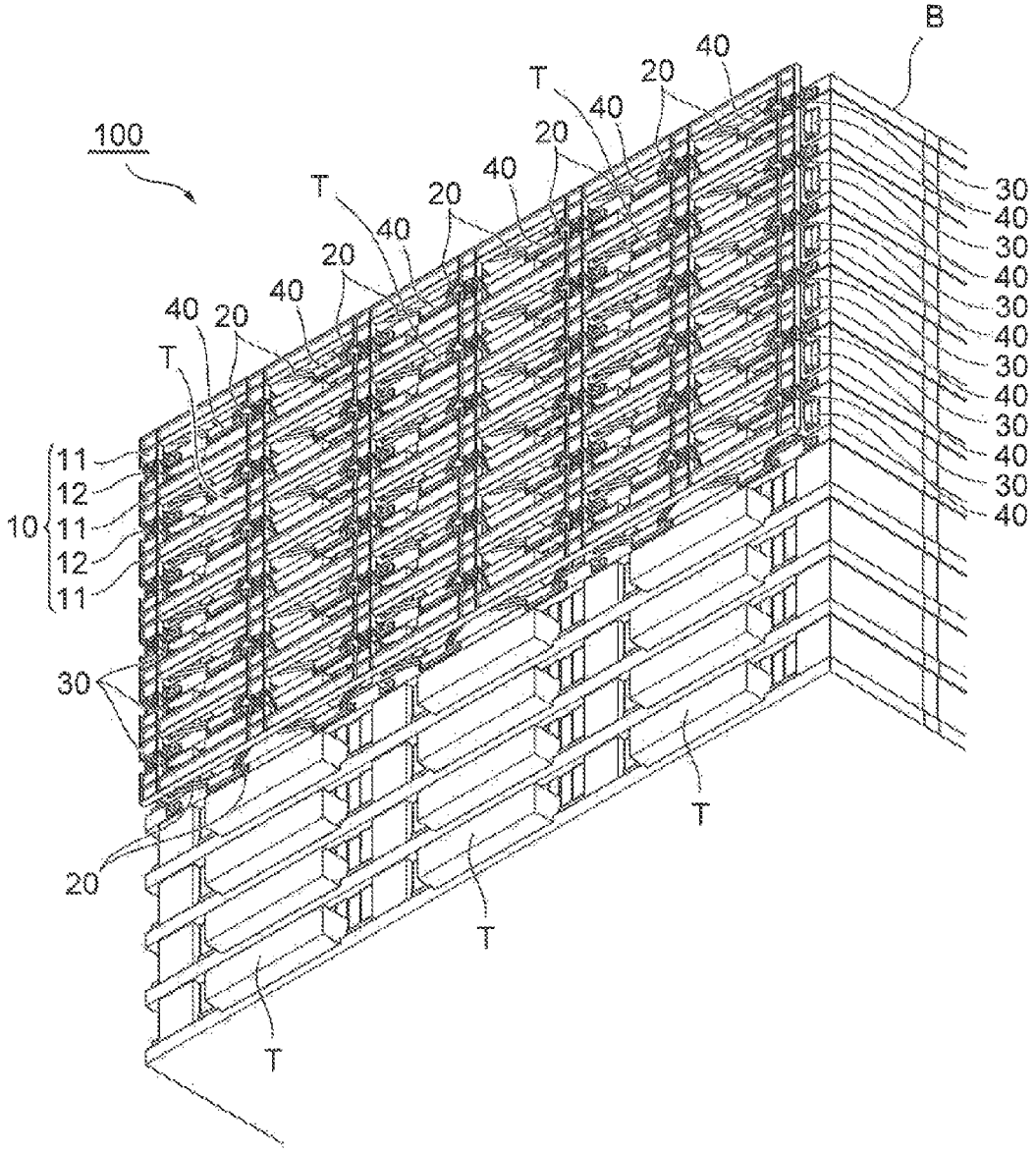
FIG. 2 schematically shows the retrofitting structure of Embodiment 1 that is provided on the outer wall surface of the existing building.
Figure 3:
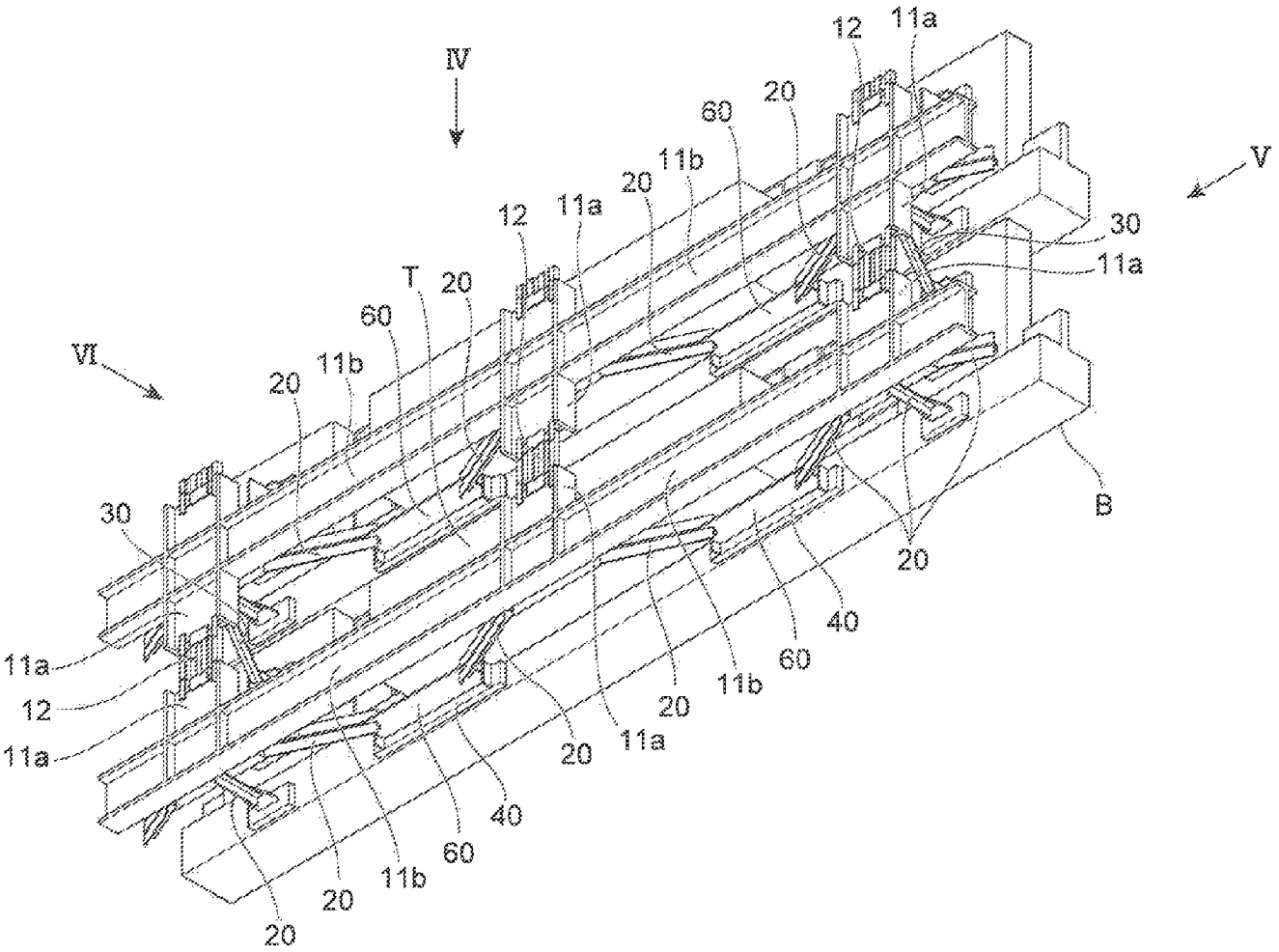
FIG. 3 is an enlarged view of a part of the retrofitting structure of Embodiment 1.
Figure 4:
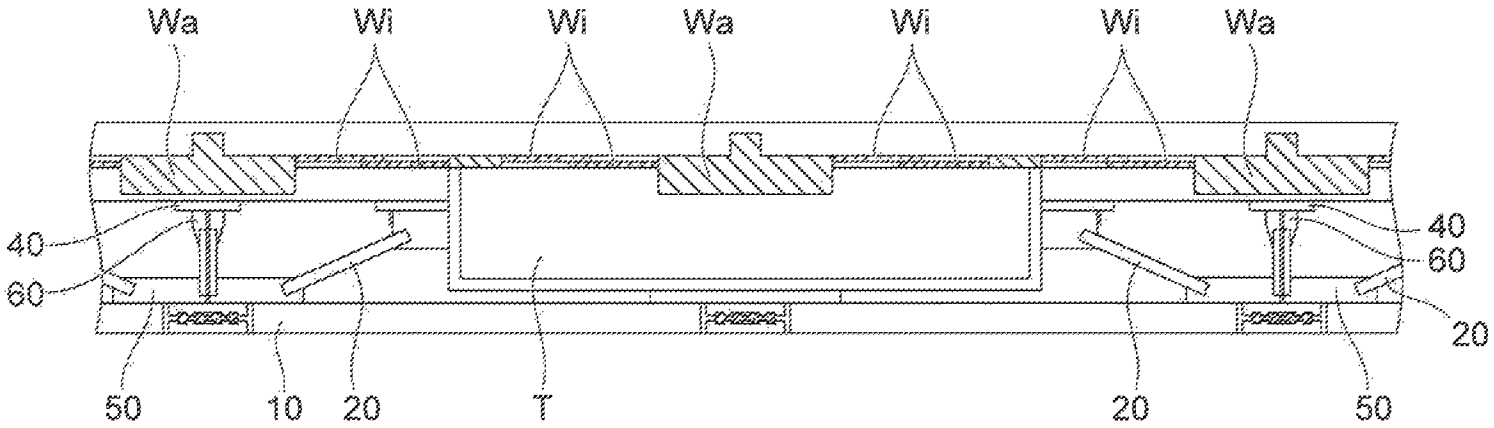
FIG. 4 is a view taken along the arrow IV of FIG. 3.
Figure 5:
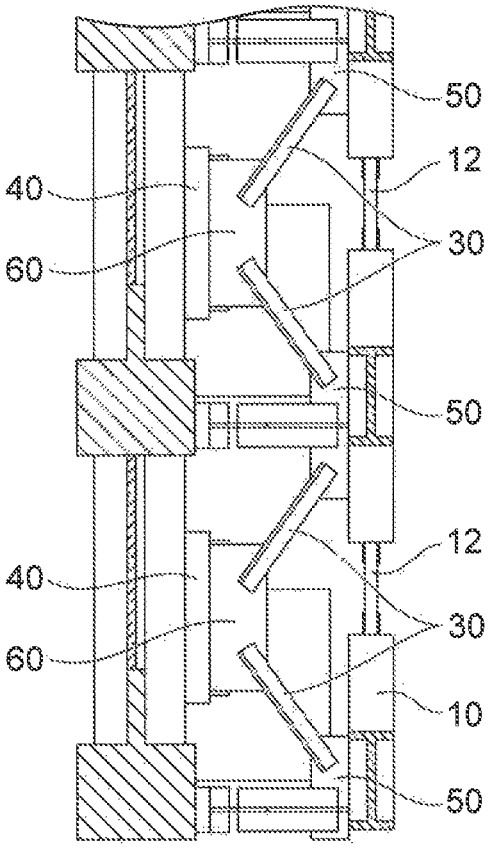
FIG. 5 is a view taken along the arrow V of FIG. 3.
Figure 6:
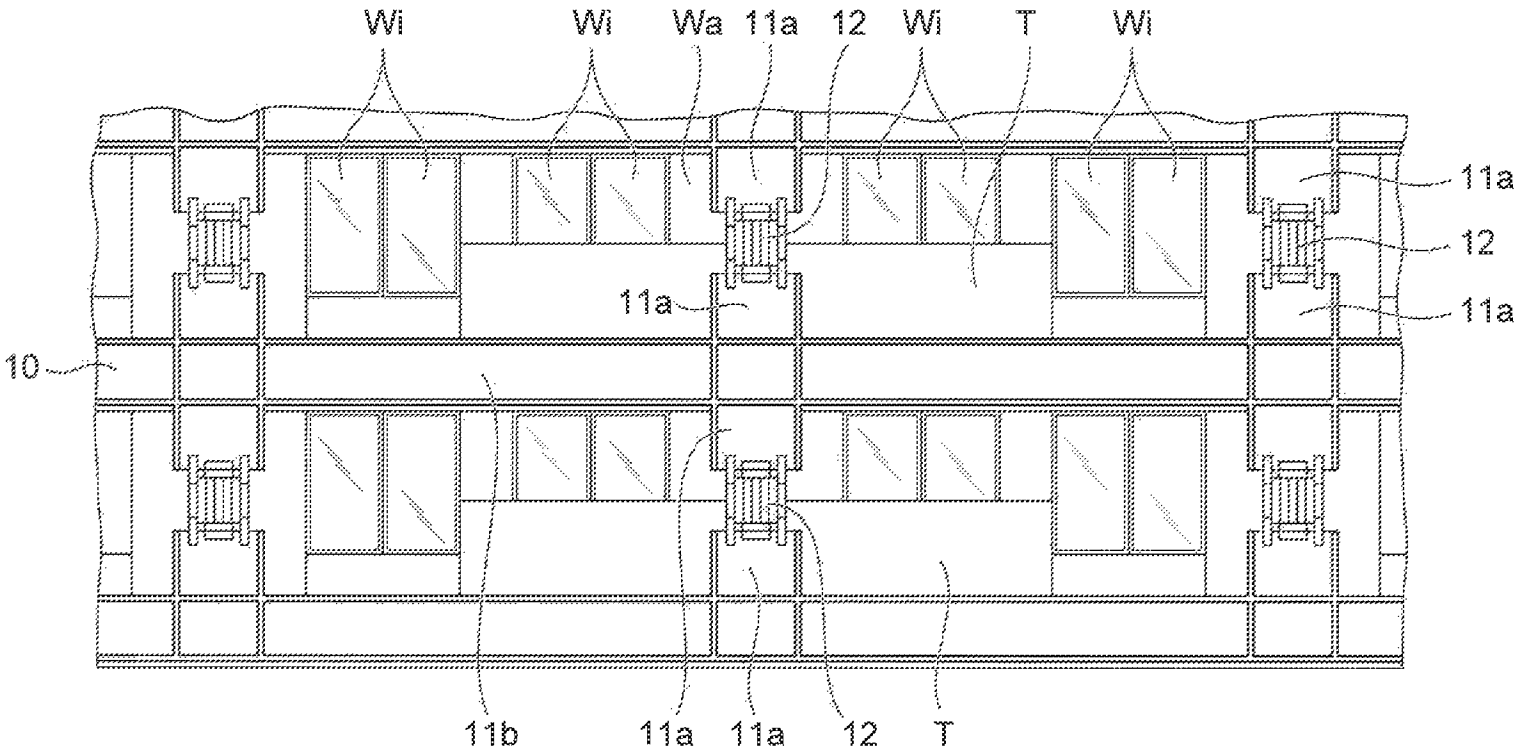
FIG. 6 is a view taken along the arrow VI of FIG. 3.

FIG. 1 schematically shows the state where a retrofitting structure of Embodiment 1 of the present invention is provided on the outer wall surface of an existing building, FIG. 2 schematically shows the retrofitting structure of Embodiment 1 that is provided on the outer wall surface of the existing building, and FIG. 3 is an enlarged view of a part of the retrofitting structure of Embodiment 1. FIGS. 4 to 6 are a view taken along the arrow IV of FIG. 3, a view taken along the arrow V thereof and a view taken along the arrow VI, respectively.

As shown in FIG. 1, the existing building B is a multi-level floor condominium having a plurality of dwelling units on each floor, where each dwelling unit is provided with a balcony T and a window Wi at the back of the balcony T (see FIG. 6).

In the illustrated form, seismic retrofitting is not required on the lower floors of the existing building B, and is installed from a middle-level floor to an upper-level floor.

A reinforcing frame 10 is prepared beforehand, which is made up of a frame member 11 including vertical members 11*a* and horizontal members 11*b* that are steel members assembled into a frame form so as to surround a balcony T of each dwelling unit from a middle-level floor to an upper-level floor (so as to surround the balcony T in the front view), and vibration control members 12 interposed at the vertical members 11*a*, and the thus prepared reinforcing frame 10 is conveyed to the site. In the illustrated example, each floor has three dwelling units, and the number of openings that are defined by the frame members 11 making up the reinforcing frame 10 is six in each row. This means that a vertical member 11*a* of the frame member 11 is provided at some position along the balcony T of each dwelling unit. As is understood also from FIGS. 4 and 6, each dwelling unit in this form has a wall Wa at the center position, and the vertical member 11*a* is provided at a position in front of this wall Wa, so that the view from the windows Wi of the dwelling units is not blocked. In another form, a groove may be provided on the outer surface of the balcony T, and a vertical member 11*a* may be disposed in this groove.

In this way, the reinforcing frame 10 is disposed so as to surround the balcony T of each dwelling unit, and is disposed at a position that does not block the view from the windows Wi.

Herein, the reinforcing frame 10 as a whole is configured by assembling steel members, such as H-steels or I-steels, into a lattice shape to make up a frame member 11, and interposing a vibration control member 12 at some position along each of the vertical members 11*a* making up the frame member 11.

As the vibration control member 12 to be interposed at some position of each vertical member 11*a*, a stud-type vibration control damper (hysteresis type damper made of steel materials, viscoelastic damper made of high-damping rubbers, and viscosity damper made of fluid) may be used.

Referring back to FIG. 1, when the reinforcing frame 10 is installed at the existing building B, connection plates 40 are firstly provided at appropriate positions of the outer wall surface of the existing building B. These connection plates 40 can be provided at the outer wall surface using an adhesion-type post-installed anchors, for example.

After the connection plates 40 are installed on the outer wall surfaces of the existing building B, then openings defined by the reinforcing frame 10 (openings defined by vertical members 11*a* and horizontal members 11*b*) are positioned so as to surround the balcony T and in the vicinity of the connection plates 40. Then the connection plates 40 and the reinforcing frame 10 are mutually connected via horizontal truss members 20 and vertical truss members 30, whereby the retrofitting structure 100 is installed on the outer wall surface of the existing building B. That is, the retrofitting structure 100 is made up of the reinforcing frame 10, the horizontal truss members 20 and the vertical truss members 30.

Each of the horizontal truss members 20 and the vertical truss members 30 can be formed with a steel member, such as a L-steel, a C-steel or a square pipe, and both of the horizontal truss members 20 and the vertical truss members 30 in the illustrated example is prepared by assembling two L-steels so as to have a T-letter shape cross section.

As shown in FIGS. 3 and 4, each of the connection plates 40 installed on the outer wall surface of the existing building B is provided with a connection piece 60 made of steel that protrudes from the connection plate 40, and the frame member 11 of the reinforcing frame 10 also is provided with connection pieces 50 made of steel.

The connection pieces 50, 60 are inserted into gaps between two L-letter shaped abutting ends making up the horizontal truss members 20 and the vertical truss members 30, and they are connected mutually by welding or with bolts, whereby the outer wall surface of the existing building B and the reinforcing frame 10 are connected via the horizontal truss members 20 and the vertical truss members 30.

The illustrated retrofitting structure 100 is installed so as to surround the overhangs T, such as a balcony, provided on the outer wall surface of the existing building B, which includes the reinforcing frame 10 having the vibration control members 12 that is coupled to the outer wall surface via the vertical truss members 30 and the horizontal truss members 20. In this way, the reinforcing frame 10 is installed so as to surround the balcony T, and therefore the view from the windows of the existing building B is not blocked. Further, the reinforcing frame 10 and the outer wall surface are connected via the horizontal truss members 20 and the vertical truss members 30, whereby a horizontal shear force acting on the reinforcing frame 10 can be transmitted to the existing building B via the horizontal truss members 20, and a vertical force resulting from the eccentric bending moment acting on the reinforcing frame 10 can be transmitted to the existing building B via the vertical truss members 30. Therefore this does not require the addition of a foundation specific to the retrofitting structure 100, and can implement seismic retrofitting on any floors, whereby the retrofitting structure 100 obtained can have excellent effectiveness for construction and such economic efficiency.

Next, referring to FIG. 7, a cross-sectional force generated at the members making up the retrofitting structure and a reaction force generated at the connection portion between the retrofitting structure and the existing building are described below. Specifically FIG. 7(*a*) shows a shear force at the reinforcing frame, FIG. 7(*b*) shows bending moment at the reinforcing frame, FIG. 7(*c*) shows axial forces at members making up the retrofitting structure, and FIG. 7(*d*) shows a shear force at the joint between the retrofitting structure and the outer wall surface of the existing building.

Figure 7:
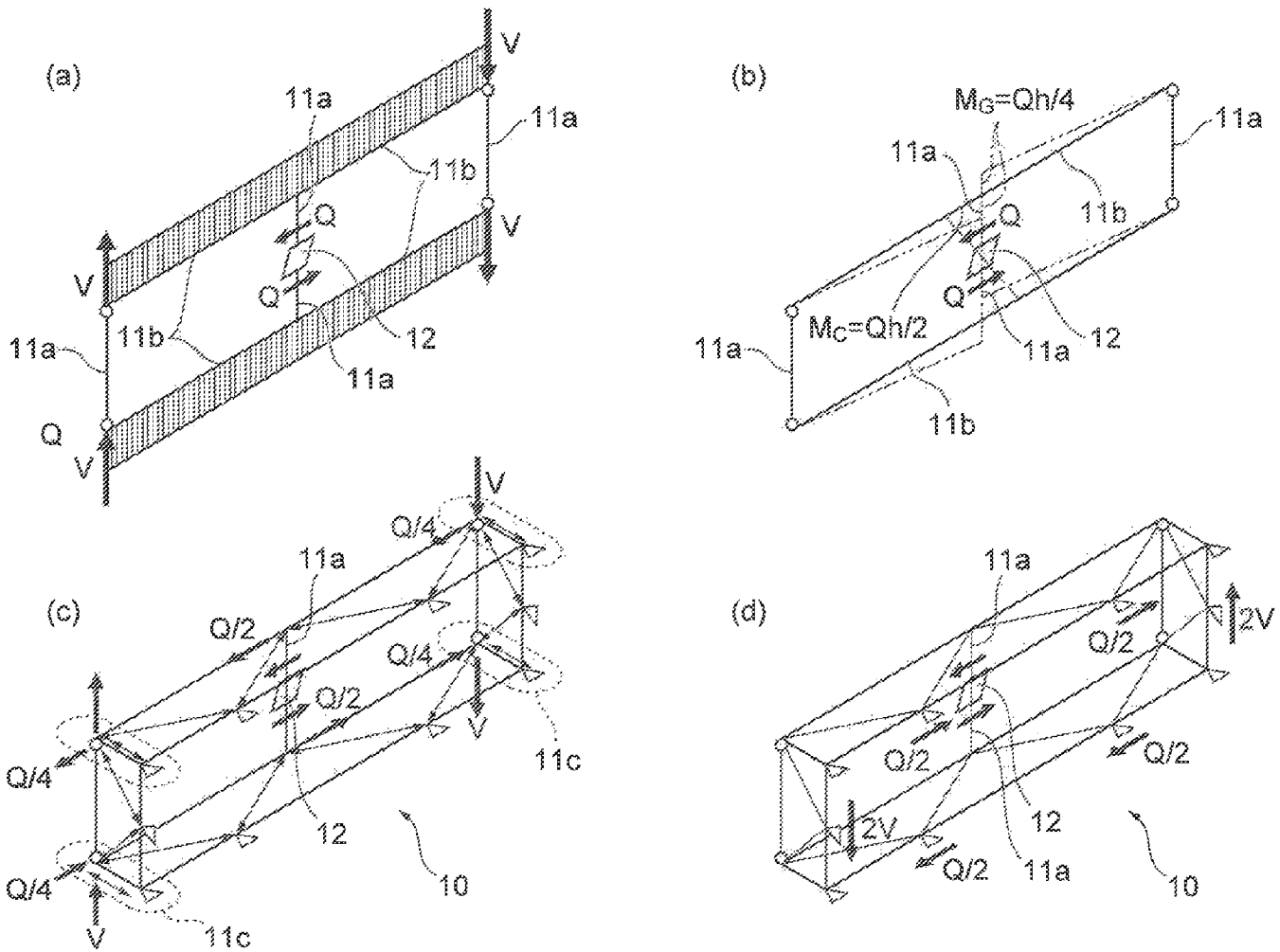
FIG. 7 describes a cross-sectional force generated at the retrofitting structure, where FIG. 7(*a*) shows a shear force at the reinforcing frame, FIG. 7(*b*) shows bending moment at the reinforcing frame, FIG. 7(*c*) shows axial forces at members making up the retrofitting structure, and FIG. 7(*d*) shows a shear force at the joint between the retrofitting structure and the outer wall surface of the existing building.

In FIG. 7(*a*) showing a shear force, a shear force Q acts on a stud-type damper interposed between vertical members at the center during earthquake. Then, due to this shear force Q, a shear force V(=Q×w×h/2) acts on the horizontal members 11*b* (horizontal beams) of the reinforcing frame 10, and bending moment acting on the reinforcing frame is transmitted to the horizontal truss members and the vertical truss members, and therefore a local shear force in the direction orthogonal to the axis of the members, which poses a problem to a stud-type damper and results from transmission of bending moment to the joints between the retrofitting structure and the outer wall surface of the existing building, does not occur. A shear force only will be transmitted to the horizontal truss members and the vertical truss members.

As shown in FIG. 7(*b*), bending moment $M_G$(=Q×h/4) is generated at the central vertical member of the connection frame, and bending moment Mc(=Q×h/2) is generated at the horizontal beams at the connection portion with the central vertical member.

Next. FIG. 7(*c*) shows the distribution of axial forces of trusses making up the reinforcing frame, where an axial force $N_q$ acting against eccentric bending moment due to the shear force Q acting on the stud-type damper 12 can be represented as $N_q$=Q×d/w.

Meanwhile an axial force Nv acting against eccentric bending moment of the shear force V at the horizontal members 11*b* can be represented as Nv=2V×d/h=Q×d/h.

In this way, since an axial force is a force where the tensile force and the compression force have the same value and are in the same direction, the axial force at the bundle member 11*c* can be represented as N=Nq+Nv=2Q×d/h.

FIG. 7(*d*) shows the support reaction forces due to an axial force of a truss making up the reinforcing frame 10, which is used for design load at the connection portion between the existing building B and the retrofitting structure 100. Herein no bending moment is transmitted to this connection portion, and a tensile force and a shear force will be transmitted there. Then, this shear force acts in the axial direction of the members making up the reinforcing frame 10 only, thus facilitating the design at the connection portion between the members making up the reinforcing frame.

(Embodiment 2 of Retrofitting Structure for Existing Building)

Figure 8:
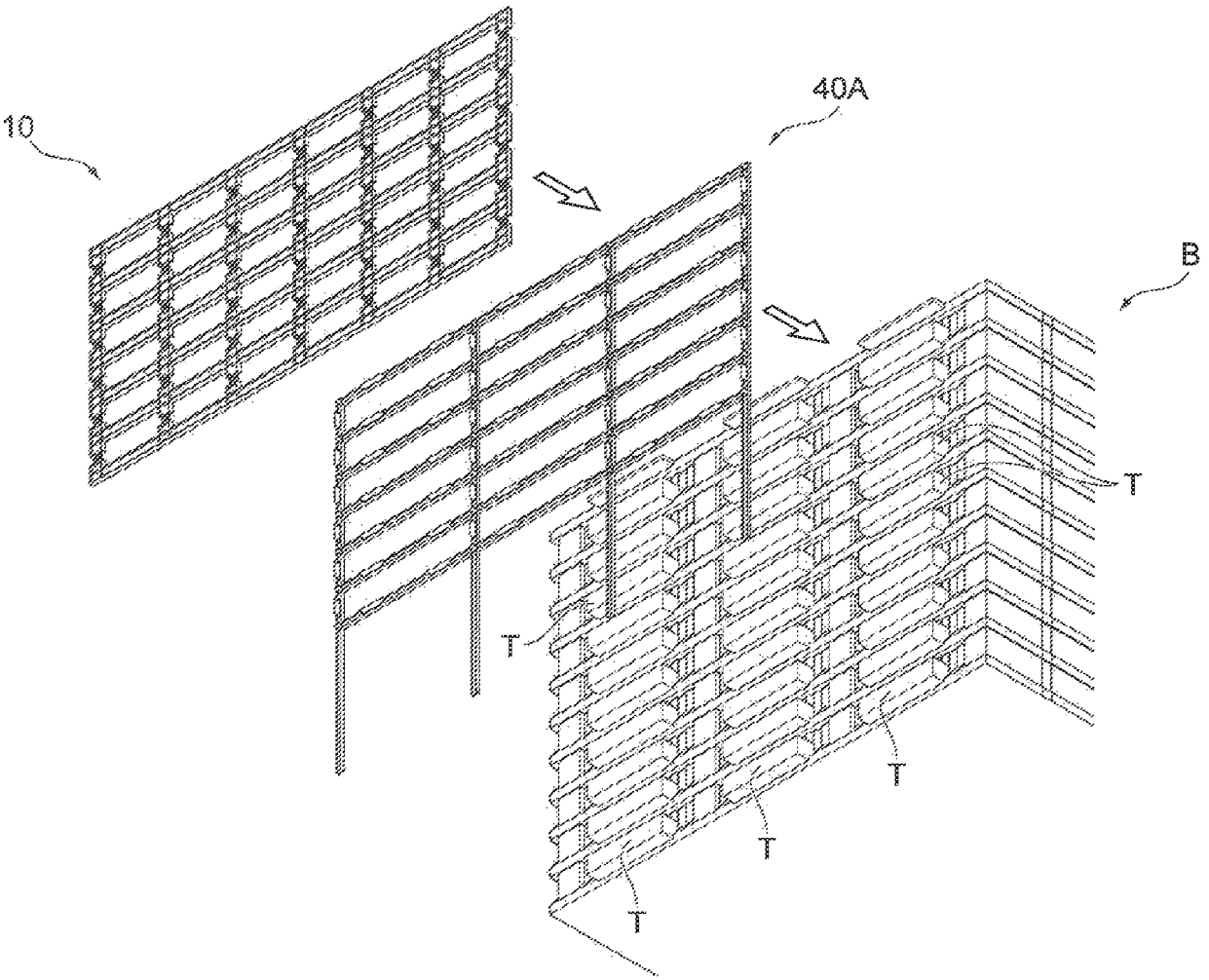
FIG. 8 schematically shows the state where a retrofitting structure of Embodiment 2 of the present invention is provided on the outer wall surface of an existing building.
Figure 9:
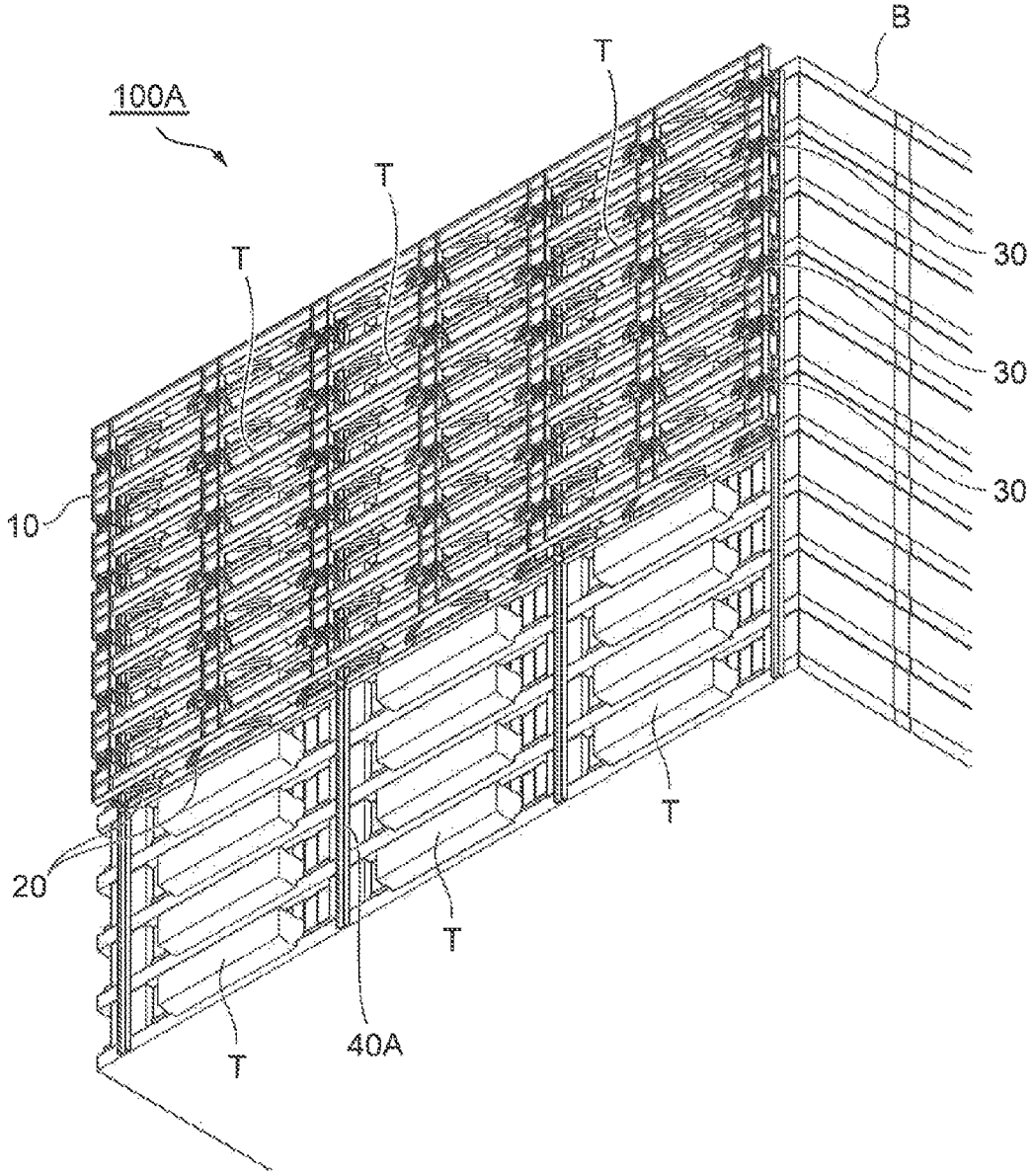
FIG. 9 schematically shows the retrofitting structure of Embodiment 2 that is provided on the outer wall surface of the existing building.
Figure 10:
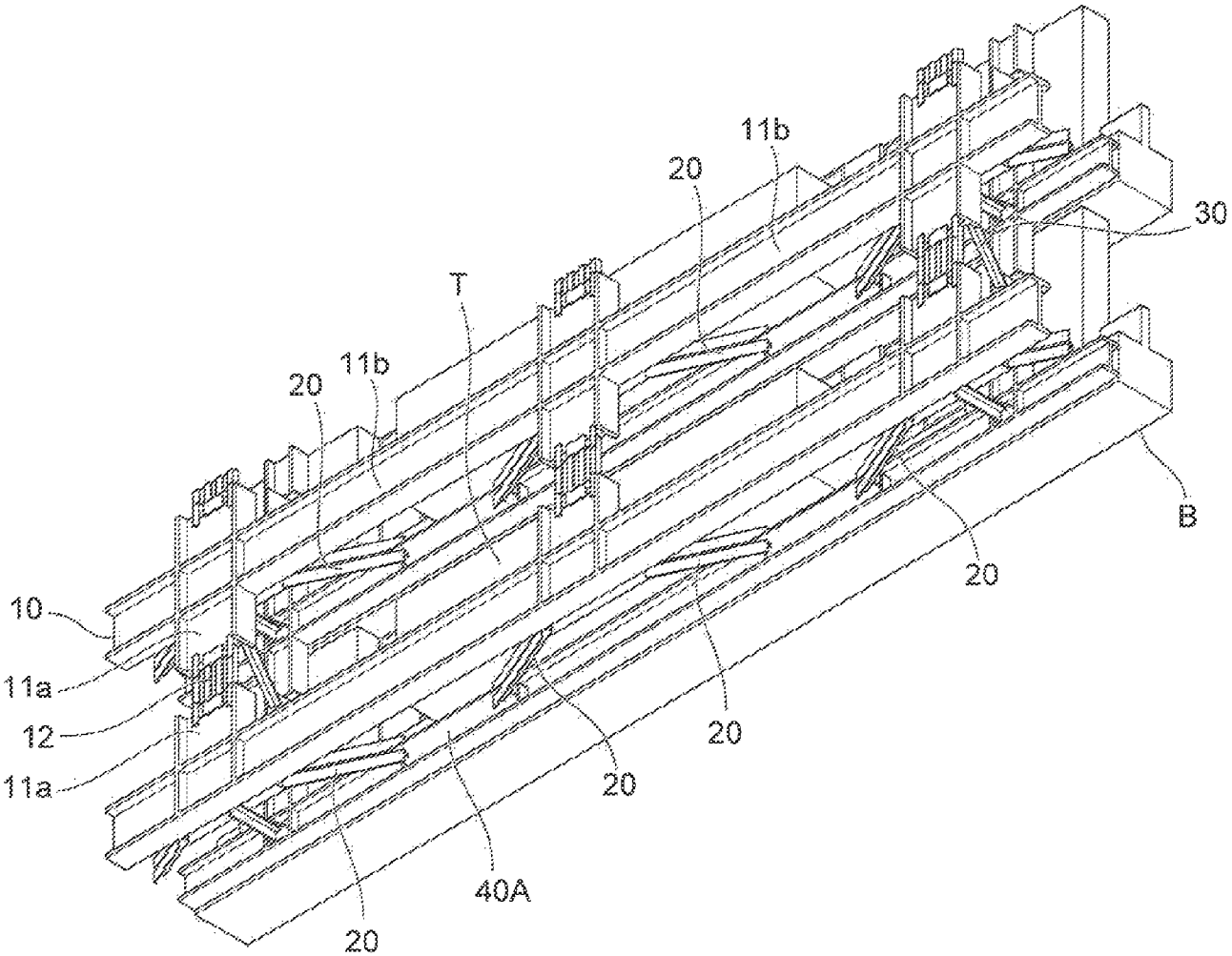
FIG. 10 is an enlarged view of a part of the retrofitting structure of Embodiment 2.
Figure 11:
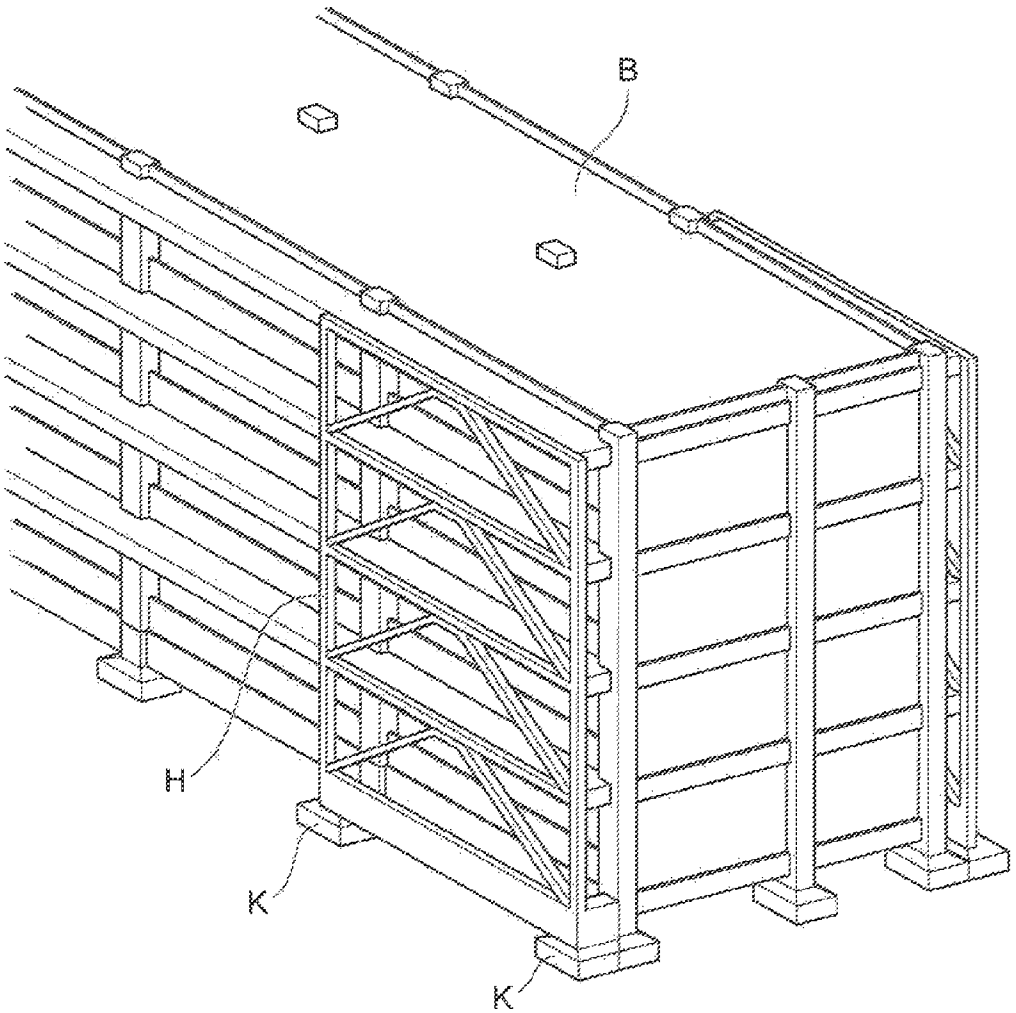
FIG. 11 schematically describes a conventional method of adding a framed steel brace structure.
Figure 12:
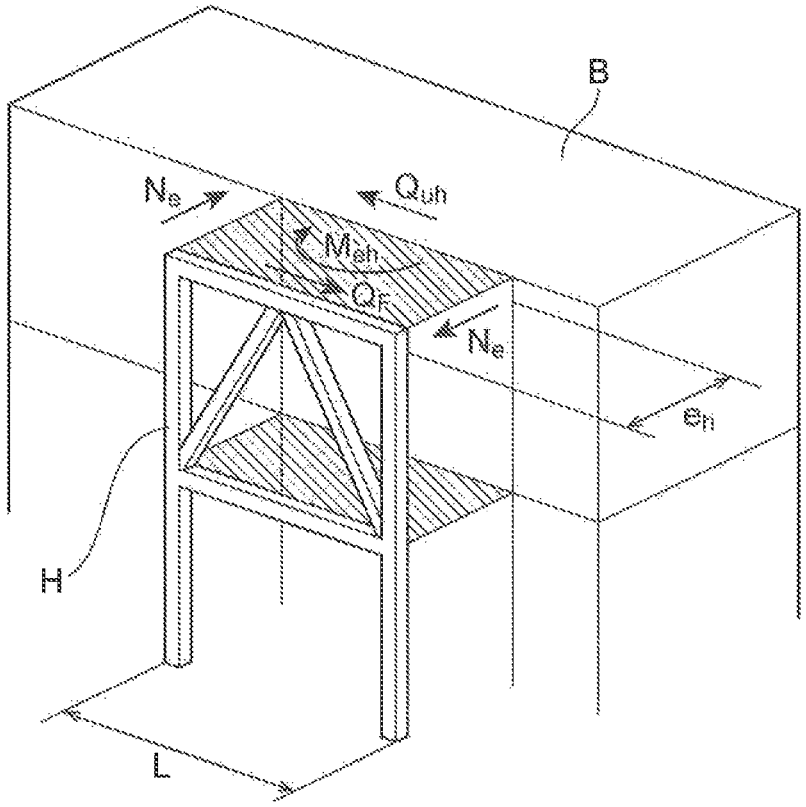
FIG. 12 schematically shows cross-sectional forces generated at the framed steel brace structure.
Figure 13:
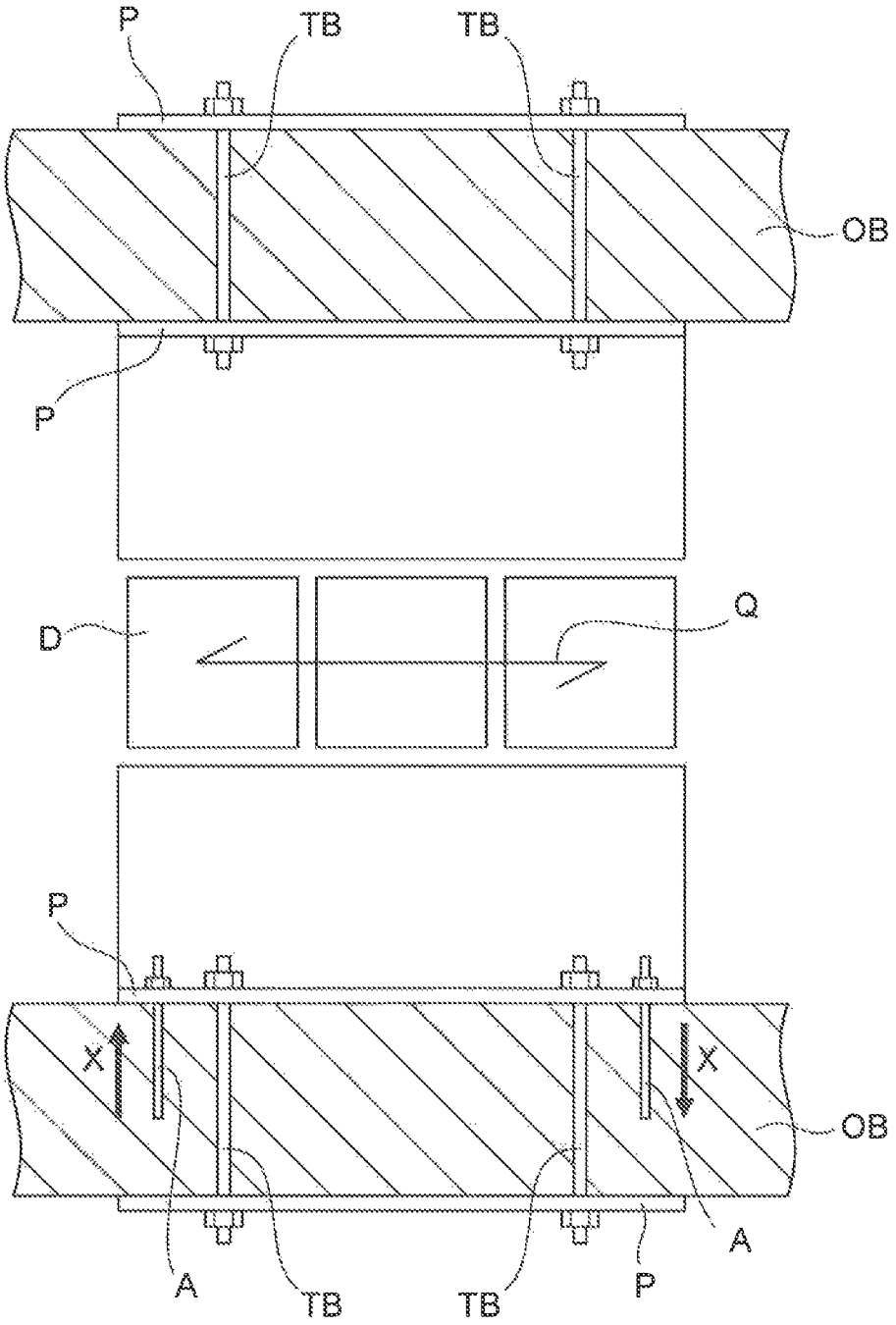
FIG. 13 schematically describes a retrofitting structure by a conventional stud-type damper.

Referring to FIGS. 8 to 10, a retrofitting structure for existing building that is Embodiment 2 is described below. FIG. 8 schematically shows the state where a retrofitting structure of Embodiment 2 of the present invention is provided on the outer wall surface of an existing building, FIG. 9 schematically shows the retrofitting structure of Embodiment 2 that is provided on the outer wall surface of the existing building, and FIG. 10 is an enlarged view of a part of the retrofitting structure of Embodiment 2.

The retrofitting structure 100A in the drawings is configured by attaching a connection frame 40A made of steel on the outer wall surface of the existing building B using an adhesion-type post-installed anchors, and then connecting the reinforcing frame 10 and the connection frame 40A via horizontal truss members 20 and vertical truss members 30.

As shown in the drawings, the connection frame 40A includes vertical members only at a part corresponding to the lower-level floors where seismic retrofitting is not required.

Instead of attaching a large number of connection plates 40 on the outer wall surface of the existing building B as in the retrofitting structure 100, the connection frame 40A that is assembled beforehand is attached on the outer wall surface, whereby the retrofitting structure 100A can be installed in a shorter construction period than that of the retrofitting structure 100.

In this retrofitting structure 100A as well, a cross-sectional force generated at the reinforcing frame 10, axial forces generated at the members making up the structure, and reaction forces at the connection portions between the reinforcing frame 10 and the connection frame 40A are the same as those shown in FIG. 7.

Therefore, in this retrofitting structure 100A as well, the support reaction forces due to an axial force of a truss making up the reinforcing frame 10 is used for design load at the connection portion between the existing building B and the retrofitting structure 100A, and no bending moment is transmitted to this connection portion, and a tensile force and a shear force will be transmitted there.

While certain embodiments of the present invention have been described in details with reference to the drawings, the specific configuration is not limited to the above-stated embodiments, and it should be understood that we intend to cover by the present invention design modifications without departing from the spirits of the present invention.

REFERENCE SIGNS LIST

10 Reinforcing frame
11 Frame member
11*a* Vertical member
11*b* Horizontal member
11*c* Bundle member
12 Vibration control member (stud-type damper)
20 Horizontal truss members
30 Vertical truss members
40 Connection plate
40A Connection frame
50, 60 Connection piece
100, 100A Retrofitting structure
B Existing building
T Balcony (overhang)

The invention claimed is:

1. A retrofitting structure for existing building comprising:

a reinforcing frame including a frame member and a vibration control member interposed in the frame member, the reinforcing frame being provided on an outer wall surface of an existing building having an overhang on the outer wall surface so as to surround the overhang; and a vertical truss member and a horizontal truss member configured to couple the reinforcing frame and the outer wall surface, wherein a horizontal shear force acting on the reinforcing frame is transmitted to the existing building via the horizontal truss member, and a vertical force resulting from eccentric bending moment acting on the reinforcing frame is transmitted to the existing building via the vertical truss member.

2. A retrofitting structure for existing building comprising:

a connection frame including a frame member, the connection frame being provided on an outer wall surface of an existing building having an overhang on the outer wall surface so as to surround the overhang;

a reinforcing frame to be connected to the connection frame, the reinforcing frame including a frame member and a vibration control member interposed in the frame member; and a vertical truss member and a horizontal truss member configured to couple the connection frame and the reinforcing frame, wherein a horizontal shear force acting on the reinforcing frame is transmitted to the existing building via the horizontal truss member and the connection frame, and a vertical force resulting from eccentric bending moment acting on the reinforcing frame is transmitted to the existing building via the vertical truss member and the connection frame.

3. The retrofitting structure for existing building according to claim 1, wherein the vibration control member includes any one of a stud-type damper, a brace, and a brace with a damper.

4. The retrofitting structure for existing building according to claim 1, wherein the overhang includes any one type or a plurality of types of a balcony, a externally-attached louver, and eaves.

5. The retrofitting structure for existing building according to claim 1, wherein a plurality of the overhangs are provided at the existing building with intervals in the vertical direction and in the horizontal direction, and the retrofitting structure is attached to a part of the overhangs only.

6. The retrofitting structure for existing building according to claim 2, wherein the vibration control member includes any one of a stud-type damper, a brace, and a brace with a damper.

7. The retrofitting structure for existing building according to claim 2, wherein the overhang includes any one type or a plurality of types of a balcony, a externally-attached louver, and eaves.

8. The retrofitting structure for existing building according to claim 2, wherein a plurality of the overhangs are provided at the existing building with intervals in the vertical direction and in the horizontal direction, and the retrofitting structure is attached to a part of the overhangs only.

* * * * *